United States Patent [19]

Barth et al.

[11] 4,194,853

[45] Mar. 25, 1980

[54] METHOD AND APPARATUS FOR PRODUCING A GROUND COVERING FROM INDIVIDUAL PAVING STONES

[76] Inventors: Günter Barth, Am Schwalbenloch 7,, D-7500 Karlsruhe 41, Grötzingen; Fritz von Langsdorff, Blumenstrasse 12, D-7551 Förch:uber Rastatt; Kurt Rossmann, D-7561 Hörden, all of Fed. Rep. of Germany

[21] Appl. No.: 893,520

[22] Filed: Apr. 4, 1978

[30] Foreign Application Priority Data

Apr. 6, 1977 [DE] Fed. Rep. of Germany ..... 2715476

[51] Int. Cl.[2] ..... E01C 5/00

[52] U.S. Cl. ..... 404/73; 404/99; 52/749; 414/429; 414/452

[58] Field of Search ..... 404/99, 73, 83, 72; 52/749, 747, 750; 214/377, 378, 6 A, 6 B, 6 BA, 6 R, 333

[56] References Cited

U.S. PATENT DOCUMENTS

| | | | |
|---|---|---|---|
| 568,147 | 9/1896 | Sheridan | 404/99 |
| 1,543,214 | 6/1925 | Luce | 214/6 A |
| 1,710,096 | 4/1929 | Luce | 214/6 A |
| 2,184,906 | 12/1939 | Buhrmann | 404/99 |
| 2,292,605 | 8/1942 | Brase | 214/378 |
| 3,427,936 | 2/1969 | Van Der Meisden | 404/73 |
| 3,825,293 | 7/1974 | Schwarz | 214/6 A |
| 4,051,966 | 10/1977 | Cotton | 214/333 X |

*Primary Examiner*—Nile C. Byers, Jr.
*Attorney, Agent, or Firm*—Spencer & Kaye

[57] ABSTRACT

A method of producing a ground covering from individual paving stones by arranging a group of individual paving stones in the form of a section of the ground covering to be produced, grasping the group by means of a lateral compressive force from two opposed sides leaving out the lower range of the paving stones in laid condition, hoisting and moving the group thus grasped to the place of laying, and depositing the group there. The vertical distribution of the compressive force is so selected that it is greater in the lower range of grasp than in the upper range of grasp.

An apparatus for carrying out this method includes a laying vehicle which carries a gripping tongs, the gripping faces of which are movable at least vertically by a means of the laying vehicle and are formed by linings diverging from the bottom to the top.

12 Claims, 1 Drawing Figure

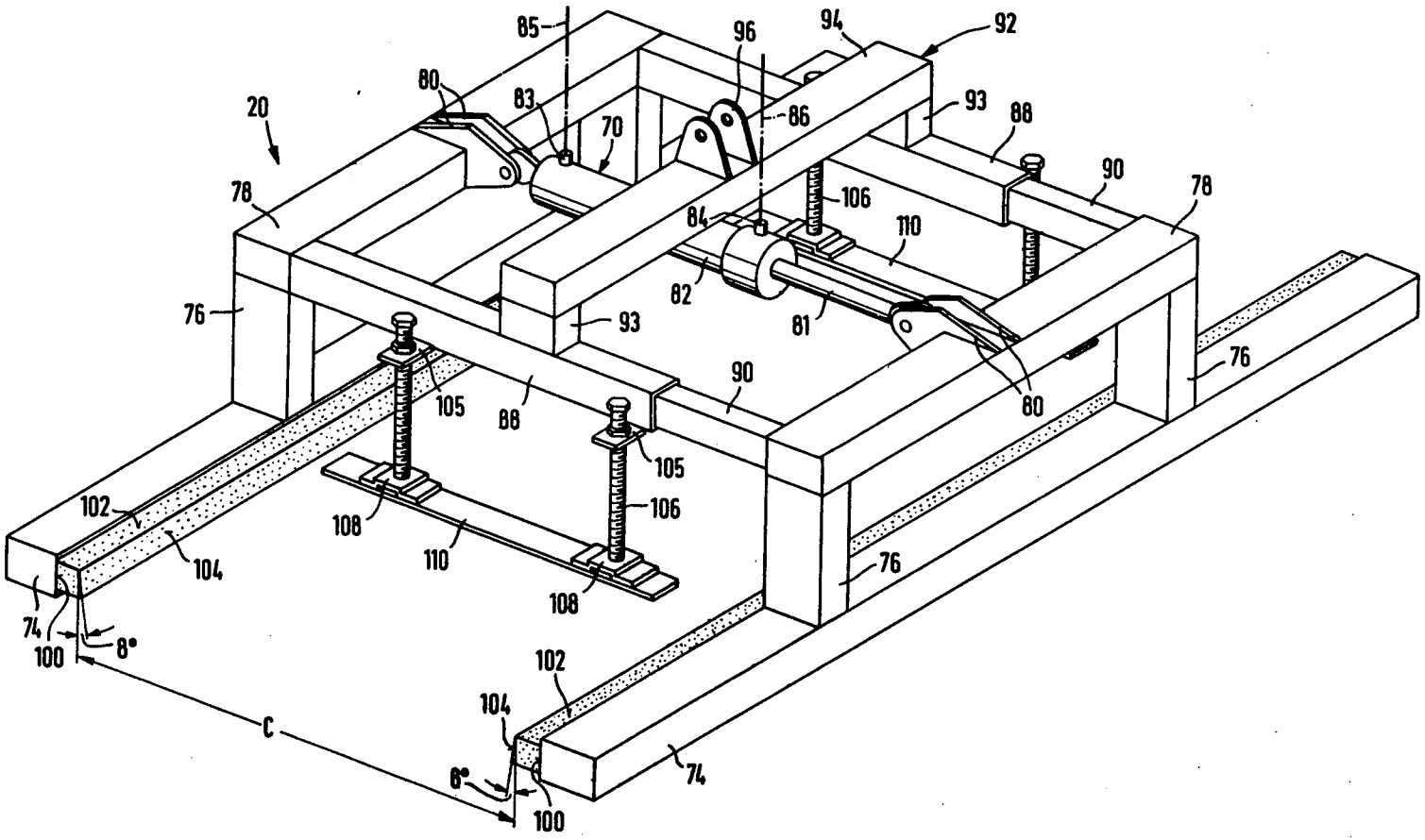
20
70
74
76
78
80
81
82
83
84
85
86
88
90
92
93
94
96
100
102
104
105
106
108
110
C
8°
6°

METHOD AND APPARATUS FOR PRODUCING A GROUND COVERING FROM INDIVIDUAL PAVING STONES

FIELD OF THE INVENTION

The invention relates to a method of and an apparatus for producing a ground covering from individual paving stones.

BACKGROUND OF THE INVENTION

It is conventional to lay paving stones individually by hand. However, this requires great expenditure for personnel and time and thus high costs for the laying.

An attempt disclosed in German Offenlegungsschrift No. 1,534,331, is known to avoid these disadvantages by prefabricating a group of individual paving stones in the form of a section of the ground covering to be produced, for instance composed of six rows of elongated paving stones in a composite structure, which are offset with respect to each other by a fraction of their length. This group is grasped as a whole by applying compressive force at two opposed outer sides of the group, for example at the two outer sides of the outside rows of the paving stones in the composite structure. This group is then moved over the pavement already laid to the place of laying where it is deposited in such manner that the laying pattern formed by the paving stones of the group will continue the laying pattern already existing.

It is customary e.g., as disclosed in East German Pat. No. 35,372 and British Pat. No. 208,182, to grasp individual paving stones, slabs to be laid, curbstones, embankment units, and the like from two sides by clamping pressure, lift them and convey them to a place of laying where they are deposited. This can be done safely even if individual elements of this kind are aligned in a single row one behind the other and this row is grasped from both sides so that each individual stone is held at both sides. As compared to that the invention is primarily but not exclusively concerned with the laying of groups of individual paving stones of the type in which at least one stone or, preferably, a plurality of stones are gripped at one side only, or not directly at all but instead are clamped only indirectly from one or more sides by neighboring stones. A borderline case under these conditions is one where two adjacent paving stones are grasped in such manner that the compressive force acting at two opposed sides acts directly at one outer side only of each paving stone and that the two paving stones are clamped against each other at their inner sides which face each other. This borderline case may be extended so that instead of each of the two paving stones a series of such paving stones is provided so that direct engagement of two adjacent rows of paving stones occurs only at one side each and that these adjacent rows of paving stones support each other at their sides facing each other under the action of the outer clamping force only. The range of application of the invention thus begins in particular in the two cases mentioned last of a pair of paving stones or of two rows of adjacent paving stones. Difficulties are encountered, above all, if one paving stone, as in the above mentioned known example, or preferably a greater number of paving stones or even a plurality of rows of paving stones, as in the cited example of six adjacent rows of paving stones in a composite structure, are held by clamping pressure alone by being framed by the outer paving stones which are directly grasped at one side. This is the normal case where a section of the ground covering to be made is prefabricated from individual paving stones of a composite structure by means of a conventional composing machine. Typical dimensions of such a section are, for example, a width of 60 cm and a length of 120 cm or, more generally, a covering area of between 0.5 and 1.5 $m^2$. The invention encompasses the laying of any size of paving stone on the market, including the composite stone disclosed in German Pat. No. 1,459,739.

In cases of the kind mentioned last, in which at least one of the paving stones is directly exposed to compression at best at one side or perhaps not at all, it proved that so far the group of individual paving stones arranged loosely beside one another cannot be grasped reliably when lying in one layer by applying compressive force from two opposed sides and cannot be hoisted and moved safely to the place of laying where they are to be deposited. Rather, the group grasped does not remain stable, but instead indirectly held stones fell down and caused the entire group to collapse. A great number of unreliable factors contribute to this situation, especially with concrete stones, among them irregularities of the surface structure, trapped sand or stone granules or other foreign matter, etc.

In a known method and the corresponding apparatus, disclosed in German Offenlegungsschrift No. 1,534,201, it was attempted to improve the known method mentioned, disclosed in German Offenlegungsschrift No. 1,534,331, by different measures so as to adapt it to actual practice. For instance, holding surfaces of gripping tongs serving to grasp the group of individual paving stones were provided with a cover of rubber-elastic material. As composite structure paving stones should be laid with projections and indentations along their periphery, the cover was given a surface structure with projections and indentations corresponding to those of the stones to be grasped directly. The gripping jaw was provided with a height stop so as to guarantee that the group of individual paving stones could be grasped only in their upper range, or height region, so that among others sufficiently large foot space of the group grasped would remain free to permit easy joining of the group to a composite arrangement of stones already laid. Above all, however, special measures were taken to avoid that the loose paving stones grasped would break down. To this end separate spacers or, if desired, integral spacers of adjacent paving stones were disposed between the individual paving stones or it was prescribed that the paving stones should be slightly widening upwardly so as to be able to form an arched structure when being grasped. However, it is irrealistic and, to say the least, involves undue extra expenditure to install separate spacers. On the other hand, mold removal causes problems if the spacers are to be formed integrally with the paving stones in their lower range in laid condition where they are practically out of sight, or if the paving stones are of such shape as to widen conically toward the top. In conventional paving stone machines the mold is retracted in upward direction. With the known shaping mentioned in accordance with the preamble, however, the stones produced subsequently would have to be rearranged by exchanging the upper side against the under side so as to arrange them in an order ready for laying. Apart from that, however, perfect retention still is not obtained when grasping a group of individual paving stones of dimensions in accordance with practical requirements. As far as the applicant knows, this causes the last apparatus for carrying out the known method to be scrapped about a year and a half ago because the known method in accordance with the preamble was considered to be without any chances.

Instead the development of methods for the mechanical laying of paving stones went in different directions in the last few years.

Instead of the lateral grasping of a group of individual paving stones by compressive force, as discussed, a known method, disclosed in German Published Application No. 1,534,193, provides to hold this group of individual paving stones by suction acting from above. However, this is not only very expensive but also susceptible to trouble in operation because the surface structure, sand, and the like, at least of concrete paving stones, obstruct close contact between the paving stone and a suction head, to say the least. Moreover, it must be assured that no flow short circuit is caused by the joints between the individual paving stones as this might cause the suction action to break down.

Therefore, in the past few years it was attempted more and more to carry out the mechanical laying of paving stones by combining the paving stones from the very beginning in mechanically joined groups of elements. To achieve that, either individually made paving stones can be combined in a mechanical laying unit by means of a separate cement substance, as disclosed in German Offenlegungsschrift No. 1,459,669, or concrete bridges designed as rated or optional breaking zones can be provided between the individual paving stones, as also disclosed in Offenlegungsschrift No. 1,459,669. Thus in practice a large plate is formed consisting of partial elements which either only give the optical impression of individual paving stones or are broken up again subsequently into individual paving stones by ground vibrators. This, however, requires at least extra expenditure as compared to the laying of individual paving stones.

Further advantages of laying loose composite structure paving stones are to be seen in the fact that damaged stones can be exchanged easily, that it is simple to lay colored stones in pavements, such as for marking parking symbols or delimiting lines, that pavement stones can be removed readily for repair work, also underground work such as the laying of telephone cables, and that finally the composite structure laid disposes of homogeneous flexibility. This is in contrast to laying units not completely decomposed into individual parts with which, upon application of a localized, or paint-like, load, plate-like ground covering areas could be stressed by lever action, lifting adjacent elements.

SUMMARY OF THE INVENTION

It is, therefore, an object of the invention to render a method of the kind defined in the preamble useful in practice in spite of the difficulties mentioned.

It is another object of the invention to provide an apparatus suitable for the above mentioned purpose.

To solve this problem it is provided in accordance with the invention in a method defined in the preamble that the vertical distribution of the pressure is so selected that the pressure is greater in the lower range of grasp than in the upper range of grasp.

Surprisingly, it was discovered that by this measure the force can be introduced into a group of individual paving stones which are grasped and lifted in clamping manner only rather than also in form lock, which would be possible in addition, in such manner that the group no longer collapses during its transportation to the place of laying. A tendency aimed at is to obtain vault-like cohesion of those stone faces which are not directly subjected to the clamping force. However, it is also sufficient if the group grasped also remains essentialy horizontal in hoisted condition, or even becomes slightly curved downwards, provided the group does not collapse and individual stones do not fall out.

In this sense it is preferably but not exclusively provided that the maximum compressive force is applied below the overall center of gravity of the group, at least with reference to its settled condition.

Leaving aside special cases, it is sufficient to grasp the group from an opposed pair of sides only. This is especially true if the section of the group of individual paving stones for the ground covering to be made contains a plurality of adjacent rows of paving stones. Yet in special cases, particularly when laying paving stones in herringbone pattern, it is preferred to grasp the group from two pairs of sides. This may also be convenient when the paving stones themselves cannot readily be reduced to a square or rectangular basic shape.

It is particularly expedient to carry out the method according to the invention in the following manner:

In the first step similar sections of the ground covering to be laid are produced at the manufacturer's plant in the form of a group of paving stones placed adjacent one another as in the later laying condition.

In the second step these groups of stones which take up areas of, for example, 0.6, 0.8 or 1.0 $m^2$ are stacked by the putting-down equipment at the manufacturer's plant to form a pack of, for example, 1 to 1.5 tons in weight and held together for transportation in a manner known per se by tape or film material (cf. the folder "Schlooser Maschinen und Anlagen Paketierung", November 1975 by Messrs. Schlosser und Co. GmbH, D-6209 Aarbergen 7; the journal "Betonstein Zeitung", December 1976, page 632: "Blitzpack-Schrumpfsystem"). It is also possible to combine them in packages on pallets ("Betonstein Zeitung", Nov. 1975, page A 53, central and lower figures).

In the third step the stone packages are transported to the building site by vehicles and are unloaded by a crane, such as a vehicle crane or a lift truck. It is known to use either clamping grippers ("Betonstein Zeitung", Nov. 1975, reverse side of title page and page 561: "Goth-Hydraulik-Steinklammer", and page A 61) or fork means mounted on lift trucks for grasping such stone packages.

In the fourth step conveniently the respective stone package becomes the object of intermediate transport by means of a lift truck, e.g. the same one as used in the third step or a front loader with fork means conveying the stone package into the vicinity of the respective destination of installation.

In the fifth step, finally, a gripping tongs on the laying vehicle is adapted to grasp one layer of stones each of the stone package as a group of individual paving stones, hoist them, move them to the place of laying, and deposit them there.

If, in further development of the invention, gripping faces are used whose horizontal extension when not in engagement with the group is substantially rectilinear, these rectilinear gripping faces can be displaced horizontally from the laying vehicle, either mechanically or manually, along the side faces of the group on the stack of stones. Consequently engagement of the gripping faces in accordance with the outlines at the projections and indentations, as with the method according to the preamble is not required.

As the height of the individual paving stones becomes smaller, it becomes more difficult to grasp groups of individual paving stones composed in accordance with the invention, as explained above, by lateral clamping force alone. Even with paving stones of little height (approximately 6 cm and less), however, the method of the invention can be applied successfully. Practically, it is useful regardless of the height of the paving stones. In the ideal case the clamping pressure always should become effective below the common mass center of the group grasped. Yet as the material is rough and relative displacements are impeded correspondingly, it is also possible to locate the point of action of the clamping force at the sides somewhat higher. In any case there is a greater chance that conditions will become critical as the height of the individual paving stones becomes smaller.

Although, in accordance with the invention, the loose paving stones must be grasped along the entire side of the group so that they cannot fall out, it is still expedient from the point of view of the laying technique that each group is formed of such sections of the ground covering to be made that recesses will come to lie oposite one another upon depositing adjacent groups at their respective location. Such opposed recesses are subsequently filled by at least one additional stone each which is preferably placed manually. This avoids complicated threading of projecting individual stones into corresponding gaps in an area of the ground covering already laid when depositing the new group. It is easy to grasp the group, and no disturbance is caused by any protruding lengths of paving stones.

The method according to the invention is suited not only for the laying of concrete paving stones but also for laying paving stones of substitute materials, for example also plastics. The method according to the invention can be carried out as the known method according to the preamble, disclosed in German Offenlegungsschrift No. 1,534,201, by using a laying vehicle which carries a gripping tongs, the gripping jaws of which are provided with elastically resilient linings to grasp the group of individual paving stones. The gripping tongs is adapted for reciprocating movement at least in vertical direction by a means provided on the laying vehicle. This lifting motion can also be effected by an energy means (spring, counterweight) mounted on a wheelbarrow.

In general, however, a laying vehicle is used which conveniently can drive as a handbarrow or with its own drive means over the area of the ground covering already laid. Driving over the ground covering laid is preferred to driving over the prepared sand bed so as to avoid impairing the prepared condition by undesired compressions, material dislocations, and the like.

The gripping tongs in the present context is understood to be any kind of gripper which has at least two opposed gripping jaws adapted to be moved into and out of clamping engagement with a group of paving stones positioned in between.

An alteration of the compression in the direction of height in the sense of the invention could be realized by separate pressurization of individual zones of elastic engagement above one another at the group of stones. Yet this is relatively expensive. Therefore, it is preferred to apply uniform compressive force to the gripping tongs in order to carry out the method according to the invention. For this event the gripping face could be composed of lining elements of different elasticity in the direction of height. Yet this also is relatively expensive. In the preferred apparatus according to the invention, rather, the gripping faces formed by the elastically yielding linings at the gripping tongs diverge from the bottom to the top. The desired different distribution of the compression thus is obtained by different deformation of the elastically yielding lining. This effect of obtaining the different pressure distribution by different deformation of the lining at an angular position between the side face grasped of the paving stones of the group and the holding face of the gripping tongs is the most distinct if the thickness of the lining conveniently is constant and the holding faces each are inclined at an angle of at least approximately 3°, preferably at least 5° with respect to the vertical.

In further development of the method it is provided that the holding faces of the gripping tongs in addition to being inclined or, perhaps, also instead of being inclined are so designed that that holding face which is more remote from the area already laid grasps the stone group to be laid at a place lower than the opposed holding face. Hereby the compressive force does not act horizontally through the group of stones but instead diagonally.

The lining forms an essentially rectilinear gripping face along the gripping jaw to be deformed only upon grasping of the group in order to make it easier for the person operating the laying vehicle to get hold of the group. Yet this is not a requirement; it is also possible for the gripping jaws to be adapted to the outline of the stone.

It is expedient within the framework of the invention to use more versatile laying vehicles, at least for laying ground coverings of large area and to employ handbarrows or wheelbarrows for small areas.

The laying vehicle may comprise a double arm outrigger which is adapted to be lifted and bent independently, one of these two functions being designed as coarse adjustment and the other one as fine adjustment of the gripping tongs position. Hereby the principal translational movement to the place of laying can be effected by one function, whereas the second function is used for relatively fine adjustment of the gripping tongs to the place of laying from the laying vehicle. This is followed by the final fine adjustment of the gripping tongs position made either by the helper by hand or by means of a separate power-actuated pressure fluid source so as to deposit the group of paving stones.

Alternatively the laying vehicle may compries an outrigger adapted to be lifted and provided with a carriage which carries the gripping tongs. In this case one of the two functions of the outrigger motion and carriage displacement is designed as the coarse adjustment and the other one as the fine adjustment of the gripping tongs position. Yet it is also possible to effect the horizontal movement of the carriage by hand and the vertical movement of the gripping tongs by an auxiliary unit.

With both kinds of operation it is possible to let the laying vehicle remain firmly in position for some laying procedures.

It is known with gripping tongs for grasping loose paving stones as disclosed in German Offenlegungsschrift No. 1,534,201, to provide a sensor for adjustment of the grasping level of the gripping tongs at the group of paving stones. According to the invention, however, conveniently a height adjustment means of the sensor is provided so as to obtain exact application of the maximum compressive force.

BRIEF DESCRIPTION OF THE DRAWING

The invention will be described further, by way of example, with reference to the accompanying diagrammatic drawing FIGURE which shows an embodiment of a gripping tongs to be used with the invention.

DETAILED DESCRIPTION OF THE PREFERRED EMBODIMENT

As shown in the FIGURE, the nippers or gripping tongs 20 are essentially composed of square tubes, closed at the ends. Two opposed square tubes constitute gripping jaws 74. Two columns 76 each are arranged upright on the same, observing symmetry with respect to the center. The free ends of the columns are interconnected by traverses 78. Two webs 80 each, directed inwards, are connected by welding to the middle of traverses 78. Between these webs the piston rod 81 and cylinder 82 of a double acting hydraulic cylinder 70 having connections 83 and 84 for alternating communication with the pressure fluid outlet and return of a conventional hydraulic pump through pressure lines 85 and 86 are pivotally connected.

The traverses 78 extend in parallel with the gripping jaws 74 and are closed in the manner of a frame by two guide rails 88 which are directed from the ends of one traverse 78 to the ends of the other one and in which push rods 90 are received telescopically which in turn are directed from the ends of the other traverse 78 toward the first mentioned one. The push rods 90 are guided for sliding movement in the guide rails 88.

Telescopic displacement of the push rods 90 in their guide rails 88 in one or the other direction is effected by corresponding pressurization of the double acting hydraulic cylinder 70.

A yoke 92, comprising two spacers 93 and a connecting beam 94 on top of the same, bridges the guide rails 88 halfway between the gripping jaws 74. A pair of webs 96 is welded to the middle of connecting beam 94. The gripping tongs 20 may be suspended by these webs, for instance from a hydraulic rotary head and in a manner so as to be pivotal about an axis extending along connecting beam 94, but otherwise not rotatable.

The holding faces 100 of the two gripping jaws 74 facing each other each are provided along their lengths with a lining 102 of constant thickness of a rubber-elastic material which is commercially available from several suppliers and which is resistent to high pressure, aging, notch impact, and abrasion. For example, it may be a mixture of natural and synthetic rubber at a ratio of approximately 1 : 1 containing additives, if desired, which improve the properties mentioned. The vertical faces of the linings 102 facing each other constitute gripping faces 104 for engagement with the respective stones of the group.

The gripping faces 104 provided by the linings 102, and thus also holding faces 100, each are inclined at an angle of about 8° C. with respect to the vertical.

Preferably, one of the gripping jaws 74 together with its lining 102 and the respective gripping face 104 extend further downwards vertically or are disposed lower than the other gripping jaw 74. During the laying procedure the lower gripping jaw 74 is used at the end remote from the stones already laid because there the already existing pavement bed will not present an obstacle as it does at the opposite gripping jaw 74.

The spacing between the gripping faces 104 is marked c. This spacing c is adjustable by the double acting hydraulic cylinder 82 for opening and closing the gripping tongs, for example between 55 and 75 cm.

The lining 102 may be vulcanized directly on to the gripping jaws 74. Yet it is also possible to provide a separate metal bar as carrier.

Both guide rails 88 are provided with outwardly directed lugs 105 at either side of the yoke 92 and approximately evenly spaced from the same. A threaded bolt 106 each is screwed into threaded bores in the lugs so as to extend downwards. The free ends of the threaded bolts 106 each carry a non-rotating retainer plate 108, and a sensor bar 110 oriented transversely of the gripping jaws 74 is supported by two retainer plates 108 each.

When a group of paving stones is grasped, such as when being taken as the upper layer from a stack of stones, the sensor bar 110 rests on the upper surface of the group of paving stones. Thus the height of engagement of the gripping faces 104 at two opposed outside surfaces of the paving stones can be adjusted by corresponding screw adjustment of the threaded bolts 106. With paving stones having a height of 6 cm, the lower edge of the gripping face 104 conveniently is located approximately 4 cm below the sensor bar 110. This still leaves about 2 cm of free stone height in the group below the gripping tongs. This projecting free extension of the stone of at least 2 cm normally is needed for maneuvering so as to join the group properly to the ground covering elements already laid and serves as an abutment during the laying. If the paving stones used have a height of more than 6 cm, a corresponding projecting length of 2 cm or slightly more will still be left free. Yet conveniently the maximum compressive force will continue to be applied within the belt line in the middle of the height.

It is possible to replace the two-sided gripping tongs shown by a cross girpper in which two double acting hydraulic cylinders are installed crosswise instead of the one double acting hydraulic cylinder 70 and with which the gripping jaws are pressed against the group of paving stones from four sides. For smaller stone groups the tongs may be of such mechanical design that it closes automatically and that compressive force is exerted only by the weight of the stones.

What is claimed is:

1. A method of producing a ground covering from individual paving stones, comprising arranging a group of individual paving stones in the form of a section of the ground covering to be produced, grasping the group by means of lateral compressive force applied from two opposed sides of the group , hoisting and moving the group thus grasped to the place of laying, and depositing the group there, wherein said step of grasping is carried out by applying such lateral compressive force over a vertically extending region of each opposed side of the group in a manner to produce a vertical distribution of compressive force which is greater in the lower height region of grasp than in the upper height region of grasp and to apply a maximum compressive force below the overall center of gravity of said group, at least in deposited condition of said group.

2. A method as claimed in claim 1 wherein said step of grasping is carried out in a manner to clamp at least one paving stone in said group between paving stones which are grasped directly.

3. A method as claimed in claim 1 wherein said step of depositing is carried out in a manner to cause adjacent groups at their respective place of laying to be positioned opposite recesses, and wherein such opposed recesses are subsequently closed by insertion of at least one supplemental stone each.

4. A method as claimed in claim 1, wherein, with groups of individual paving stones having at least one recess in the periphery, compressive force is exerted also within said recess on each paving stone delimiting the inside of said recess.

5. An apparatus for carrying out the method as claimed in claim 1, comprising a laying vehicle, gripping tongs carried by said vehicle, and linings carried by said tongs and presenting gripping faces, and means on said vehicle for moving said tongs together with said linings at least vertically, wherein said gripping faces are inclined to the vertical and diverge from their lower edge to their upper edge.

6. An apparatus as claimed in claim 5, wherein said linings are supported by inclined holding faces defined by said tongs and diverging from their bottom to their top.

7. An apparatus as claimed in claim 6, wherein said holding faces of said gripping tongs are disposed at respectively different levels.

8. An apparatus as claimed in claims 5, 6 or 7, wherein each said lining forms a substantially rectilinear gripping face along said gripping tongs.

9. An apparatus as claimed in claims 6 or 7, wherein said gripping tongs is pivotal about at least one, axis.

10. An apparatus as claimed in claims 5, 6 or 7, wherein said gripping tongs is designed as a cross gripper.

11. An apparatus as claimed in claims 5, 6 or 7, , wherein said gripping tongs is provided with at least one holding cam for engaging in a lateral recess of said group and for exerting lateral compressive force on each paving stone delimiting the inside of said recess.

12. An apparatus as claimed in claims 5, 6 or 7, comprising a height adjustment means including a sensor for adjustment of the grasping level of the gripping tongs at said group.

* * * * *